US005155465A

United States Patent [19]

Tsuzuki et al.

[11] Patent Number: 5,155,465

[45] Date of Patent: Oct. 13, 1992

[54] VARIABLE RESISTOR WITH A SWITCHING MECHANISM

[75] Inventors: Takayoshi Tsuzuki; Ryohei Yabuno; Hiroshi Motoyama; Hidenori Abou, all of Aichi, Japan

[73] Assignee: Aisin Seiki Kabushiki Kaisha, Japan

[21] Appl. No.: 641,254

[22] Filed: Jan. 15, 1991

[30] Foreign Application Priority Data

Jan. 17, 1990 [JP] Japan ..... 2-007781

[51] Int. Cl.[5] ..... H01C 10/36

[52] U.S. Cl. ..... 338/172; 338/170; 338/173; 338/178

[58] Field of Search ..... 338/162, 172, 171, 167, 338/168, 170, 173, 178

[56] References Cited

U.S. PATENT DOCUMENTS 3,953,821 4/1976 Kelver et al. ..... 338/174
4,345,236 8/1982 Eichelberger et al. ..... 338/176
4,495,524 1/1985 Kakuhashi et al. ..... 338/176 X
4,751,492 6/1988 Tsuzuki et al. ..... 338/176
4,864,273 9/1989 Tsuzuki et al. ..... 338/174
4,983,946 1/1991 Kotaki et al. ..... 338/172 X

FOREIGN PATENT DOCUMENTS 62-81104 5/1987 Japan .

*Primary Examiner*—Marvin M. Lateef
*Attorney, Agent, or Firm*—Banner, Birch, McKie & Beckett

[57] ABSTRACT

A variable resistor with a switching function includes arcuate resistive layers and arcuate electrodes arranged alternately on a base plate. A protective layer is formed on the base plate adjacent to a first electrode and between the arcuate resistive layers. A gap separates the protective layer from the first electrode in order to electrically isolate the protective layer. A movable portion has brushes fixed thereto which slidably contact the resistive layers, the electrodes, and the protective layer. The protective layer serves as a lubricating layer to reduce the wear on the brush.

17 Claims, 4 Drawing Sheets

VARIABLE RESISTOR WITH A SWITCHING MECHANISM

BACKGROUND OF THE INVENTION

1. Field of the Invention

The present invention relates to an electric variable resistor with a switching mechanism having a resistive element with a layered structure. More particularly, the present invention has a switching function and a variable electric resistor in which a brush slides on a resistive element which is used, for example, as a throttle valve opening sensor for electric apparatus and vehicles.

2. Description of the Prior Art

Generally speaking, in a variable resistor of the present kind, a brush slides on a resistive element from one end to the other end thereof. A variable resistor of this kind may be incorporated in a control system in which the rotating range, for example detecting a throttle valve opening value, defined by the pitch between ends of the resistive element coincides with the rotating range of a mechanism to be controlled.

A conventional or similar throttle opening sensor is shown, for example, in Japanese Utility Model Laid-open Print No. 62(1987)-81004 published on May 23, 1987 without examination.

FIG. 1 shows a front view of the base plate of the conventional type throttle valve opening sensor. FIG. 2 shows a partial enlarged plan view of the FIG. 1.

Referring to the FIG. 1, the conventional throttle valve opening sensor basically includes a base plate (50), a plurality of electrodes (51*a*,51*b*) and resistive elements (52*a*,52*b*) with a layered structure. The electrodes (51*a*, 51*b*) and the resistive elements (52*a*,52*b*) are formed on the base plate (50). A brush (54) (shown in FIG. 2) is directly in contact with the surface of the electrodes for detecting a throttle opening value. The resistive elements (52*a*,52*b*) are independently of the electrodes (51*a*,51*b*) formed on the surface of the base plate (50). Protective layers (53*a*,53*b*) are formed on the surface of the base plate (50). The protective layers (53*a*,53*b*) have a same thickness as the electrodes (51*a*,51*b*). The protective layers which are made of synthetic resin are continuously disposed with the electrodes (51*a*,51*b*).

Referring now to the FIG. 2, the brush (54) is slidably in contact with the electrodes (51*a*,51*b*) and the protective layers (53*a*,53*b*). The brush (54) is not in direct contact with the base plate (50). Each of the electrodes (51*a*,51*b*) and the protective layers (53*a*,53*b*) have the same thickness. The protective layers (53*a*,53*b*) have a function of reducing the friction between the brush (54) and the base plate (50).

However, the conventional throttle opening sensor has drawbacks as hereinbelow. That is to say, the protective layers (53*a*,53*b*) do not produce satisfactory antifriction characteristics. When the protective layers (53*a*,53*b*) contacts the brush (54), the protective layers (53*a*,53*b*) wear out at an early stage. As a result, the brush (54) contacts the base plate directly and the portion of the brush (54) in contact with the base plate (50) wears out. Thus, the structure of the conventional throttle valve sensor can not produce a good durability.

SUMMARY OF THE INVENTION

A variable resistor with a switching function for electric apparatus and vehicles is required to have a high round durability. The variable resistor with a switching function for use in vehicles is required to have a higher round durability of some millions to hundreds of millions under hard circumstances.

Accordingly, it is, therefore, a principal object of the present invention to provide a variable resistor with a switching mechanism having a high durability.

It is another object of the present invention to provide a durable variable resistor which can be produced by a simple manufacturing method.

It is further another object of the present invention to provide a variable resistor with a switching function in a throttle valve sensor which can overcome the usual drawbacks.

In order to attain the foregoing objects, the present invention includes a variable resistor with a switching mechanism comprising, a base plate acting as a substrate, first and second arcuate resistance portions which have a layered structure and are disposed on the base plate, first and second arcuate electrode portions which have a layered structure and are disposed on the base plate, the first electrode is disposed inwardly from the first resistance portion, the second electrode is disposed inwardly from the second resistance portion, an arcuate protective layer disposed on said substrate between the first resistance portions, and a plurality of brushes fixed to a movable portion and in conductive contact with said resistance portions the electrode portions and the protective layer.

DETAILED DESCRIPTION OF THE PREFERRED EMBODIMENTS

Figure 1:
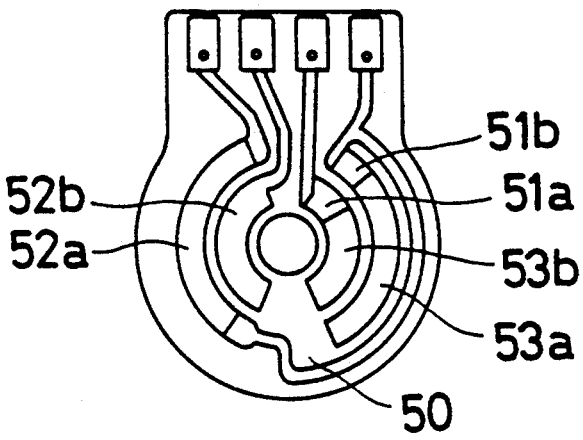
Fig. 1 (PRIOR ART)
FIG. 1 shows a front view of a throttle opening sensor according to the prior art.
Figure 2:
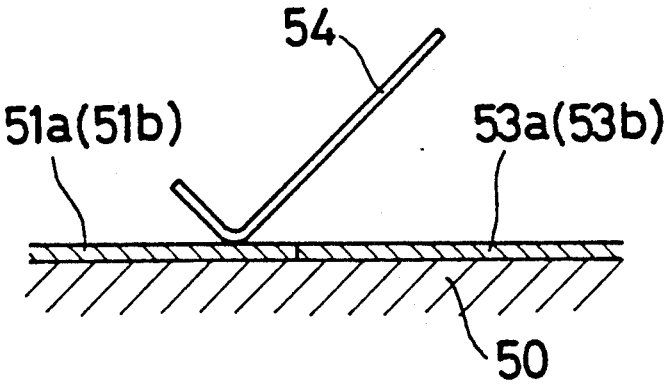
Fig. 2 (PRIOR ART)
FIG. 2 shows an enlarged cross-sectional view of an embodiment of a throttle opening sensor according to the prior art.

Referring now to the drawings, a preferred embodiment of the present invention as a throttle valve opening sensor will be explained.

Figure 3:
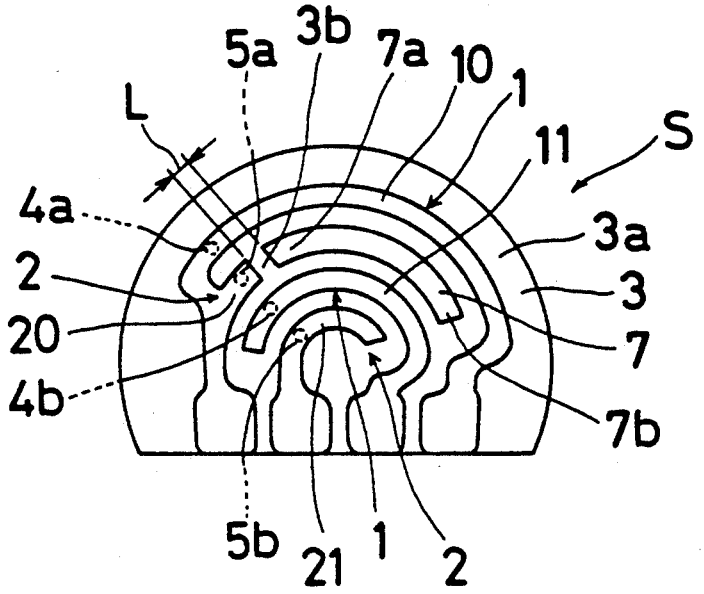
FIG. 3 shows a front view of an embodiment of a variable resistor with a switching mechanism according to the present invention.
Figure 4:
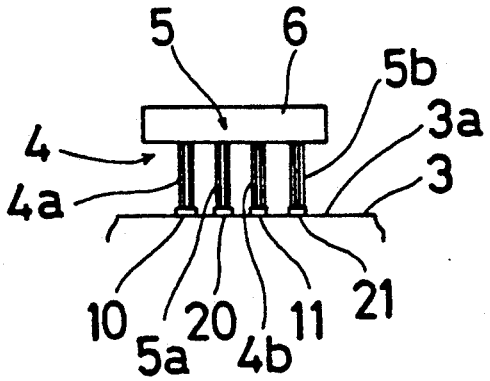
FIG. 4 shows a side view of a movable portion according to the present invention.

As shown in FIGS. 3 and 4, the conventional throttle valve opening sensor (S) includes a base plate (3) and a movable portion (6). The base plate (3) has a resistance portion (1) and a switching electrode portion (2). The movable portion (6) has a first brush (4) and a second brush (5). These brushes slidably contact with the resistance portion (1) and the switching electrode portion (2). As shown in FIG. 3, the base plate (3) represents a semi-circular shaped. The base plate (3) comprises a two layer structure, which is an inner layer and an outer layer. The inner layer is made of epoxy resin, and the outer layer is made of glass mat.

The above mentioned resistance portion (1) includes an outer resistance portion (10) and an inner resistance portion (11) which are formed on the surface of the base plate (3). The outer and inner resistance portions (10,11) are made of carbonate which is binded by phenolic resin. The outer and inner resistance portions have a two layer structure. In other words, the resistance portions having a lower layers (10*a*,11*a*) and an upper layers (10*b*,11*b*) (see FIGS. 7 and 8). Each of the resistance portions are formed on the base plate (3) and are traced circular arcs. The resistance value of the upper layers (10*b*,11*b*) is larger than that of lower one. A switching electrode portion (2) is formed on the surface of the base plate (3). The switching electrode portion (2) includes an outer switching electrode (20) and an inner switching electrode (21). The outer and inner switching electrodes (20,21) have carbon layers (20*a*,21*a*) thereon. The switching electrode portion (2) produces a switching function when the brushes con-tact with the resistance portion (1).

The movable portion (6) is indirectly connected with a throttle valve portion (not shown) by way of other mechanisms. The first and second brushes (4,5) slidably contact with the resistance portion (1)and the switching electrode portion (2), and the brushes (4,5) slide on the surface of the resistance portion (1) or the switching electrode portion (2).

Figure 9:
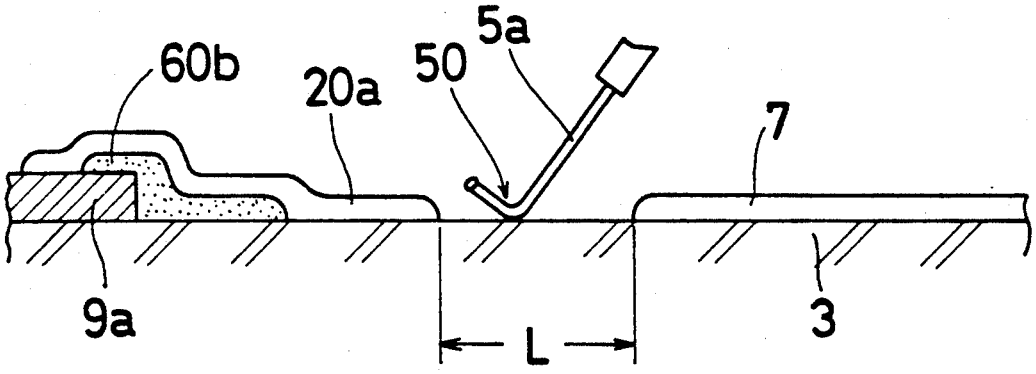
FIG. 9 shows a enlarged sectional plan view of the base plate according to the present invention.

The brush consists of a plurality of wires. A main element of the wire is platinum, silver and palladium. A bent portion 50(40) ,as shown in FIG. 9, is formed at the end portion of the brushes (4,5). The brushes (4,5) used are wire with diameters ranging from 80 to 100 micrometers. As shown in FIG. 4, the first and second brushes (4,5) are connected with the movable portion (6). The first brush (4) includes an outer first brush (4*a*) and an inner first brush (4*b*). Further, the second brush (5) includes an outer second brush (5*a*) and an inner second brush (5*b*). An electrical connection between the outer first brush (4*a*) and the inner first brush (4*b*) is established Similarly, an electrical connection between the outer second brush (5*a*) and the inner second brush (5*b*) is established.

The outer first brush (4*a*) slidably contacts with the outer resistance portion (10), and the inner first brush (4*b*) slidably contacts with the inner resistance portions (11) The outer second brush (5*a*) slidably contacts with the outer switching electrode (20), and the inner second brush (5*b*) slidably contacts with the inner switching electrode (21).

In referring to the FIG. 3, a protective-layer 7 is formed on the surface of the base plate (3). The protective layer has a lubricating function the surface of the protective layer (7). The protective layer (7) is made of the same material as the outer and inner resistance portion (10,11). The protective layer (7) is formed on the base plate (3) along the path of the contact by the outer second brush (5*a*). The protective layer (7) extends a predetermined length along the length of the path of the contact which is traced by the outer second brush (5*a*). The protective layer (7) is not electrically conducted to the other portion. In other words, the protective layer (7) is independently formed on the surface of the base plate (3). A gap (3*b*) is defined between the outer switching electrode (20) and the protective layer (7). The length (L) of the gap (3*b*) is 0.7 mm in this embodiment, and the opening angle of the edge portion of the outer switching electrode (20) from the edge portion of the protective layer (7) is 5-degrees. The length of the gap (3*b*) can be changed in steps at random. The gap (3*b*) produces an isolation function between the outer switching electrode (20) and the protective layer (7) or other portions.

On the surface of the base plate (3), a plurality of resistance layers and switching electrodes are formed, each of which is obtained or manufactured by a screen printing process which will be detailed herein after with reference to FIGS. 5 through 8.

Figure 5:
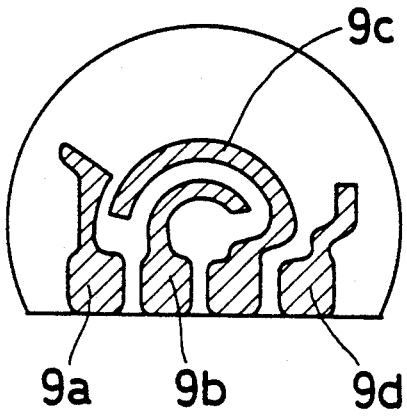
FIG. 5 shows a top view of a variable resistor with a switching mechanism first manufacturing process according to the present invention.

FIG. 5 represents a first printing process. On the surface of the base plate (3), a plurality of base electrodes (9), each of which is in the form of copper foil, are deposited by an etching process. The base electrodes (9*a*,9*b*,9*c*,9*d*), which are named first, second, third and fourth base electrodes, are formed in predetermined shapes which are used for a throttle opening sensor. In FIG. 5, each shaded portion shows the copper foil portions as the base electrodes (9). A solvent cleaning process is given to the base plate to eliminate an oxidize substance or other impurities.

Figure 6:
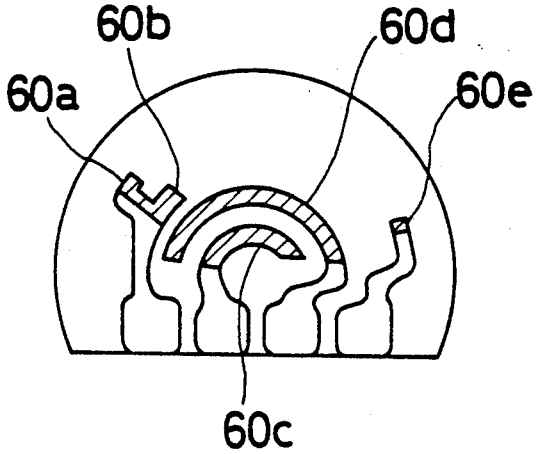
FIG. 6 shows a top view of a variable resistor with a switching mechanism second manufacturing process according to the present invention.

Next, FIG. 6 represents a second printing process. A plurality of electric terminals (60*a*,60*b*,60*c*,60*d*,60*e*), which are named first, second, third, fourth and fifth electric terminals, are formed on the surface of the base plate (3). These electric terminals (60*a*,60*b*,60*c*,60*d*,60*e*) are simultaneously screen printed on the corresponding members. The paste or paint contains a heat fusible binder and a powdered metal which is electrically conductive to the corresponding members. One suitable material as a heat fusible silver paste can be obtained from Asahi Chemical Co.,Ltd., under the designation LS-504J. The main component of the heat fusible silver paste is phenol resin and silver paste. An electrical resistor of minimum resistivity is 0.05 ohms per square of substrate. On the contrary, the electrical resistor of maximum resistivity is 0.1 ohms per square of substrate. The binder in the paste is hardened using a thermosetting process. In FIG. 6, each of the darkened portions shows the electric terminals (60 *a*, 60*b*, 60*c*,60*d*,60*e*).

Figure 7:
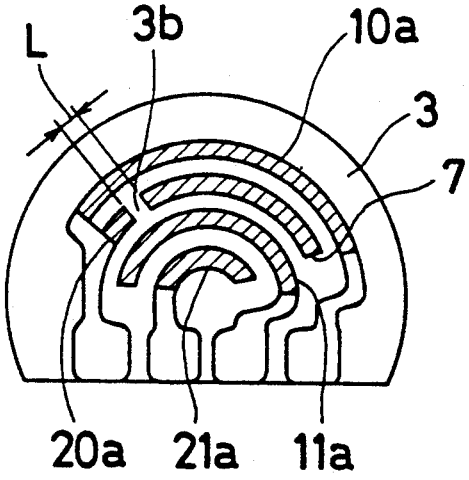
FIG. 7 shows a top view of a variable resistor with a switching mechanism third manufacturing process according to the present invention.

FIG. 7 represents a third printing process of the present invention. The lower layers (10*a*,11*a*), the protective layer (7) and the carbon layers (20*a*,21*a*) are formed on the surface of the base plate (3) or corresponding members. These layers are formed by means of a simultaneous screen printing process. The printing material as a heat fusible carbon paste can be obtained from Asahi Chemical Co.,Ltd., under the designation BTU-450. The main components of the heat fusible carbon paste is phenol resin, carbon and filler. An electrical resistor having a resistivity of 450 ohms per square of substrate is provided. Each of the darkened portions shows the carbon paste layer which is screen printed by the third printing process. The lower layer (10*a*) is continuously formed between the first electric terminal (60*a*) and the fifth electric terminal, (60*e*), and the lower layer (10*a*) is arcuate. The carbon layer (20*a*) is formed on the surface of the second electric terminal (60*b*). The protective layer (7) is directly formed on the surface of the base plate (3). The gap (3*b*) is defined between the carbon layer (20*a*) and the protective layer (7). The carbon layer (21*a*) is formed on the surface of the third electric terminal (60*c*). The lower layer (11*a*) is formed on the surface of the fourth electric terminal (60*d*).

Figure 8:
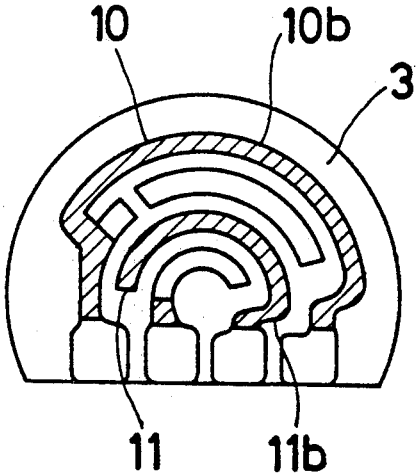
FIG. 8 shows a top view of a variable resistor with a switching mechanism fourth manufacturing process according to the present invention.

Furthermore, referring now to the FIG. 8, the upper layers (10*b*,11*b*) are directly screen printed over the lower layers (10*a*, 11*a*) respectively. The raw material of the upper resistive layers (10*b*,11*b*) to be screen printed is a heat fusible carbon paste which is obtained from Asahi Chemical Co.,Ltd., under the designation BTU-1K. An electrical resistance value of resistivity of 1K(1000) ohms per square of substrate is provided. In FIG. 8, the darkened portion shows the carbon paste layers which are screen printed by the fourth printing process. The outer resistance portion (10) and the inner resistance portion (11) establishes a resistive electrode having a two layered structure which is obtained from the resistive materials.

The operation and utility or merits of the present throttle opening sensor will be described hereinbelow.

First of all, an initial point of the throttle opening sensor is defined at a point on the circular portions in the FIG. 3. The movable portion (6) moves in accordance with the moving value of a throttle valve opening value (not shown). As a result, the first and second brushes (4,5) are in sliding conductive contact on the surface of the layer structure.

The outer first brush (4*a*) is continuously in sliding conductive contact on the surface of the outer resistance portion (10). The inner first brush (4*b*) is continuously in sliding conductive contact on the surface of the inner resistance portion (11). As a result, a resistance value of the resistance portion (1) changes. Thus, the resistance value change can be produced in accordance with the opening value of the throttle valve. In accordance with the moving of the movable portion (6), contact or no contact between the outer second brush (5*a*) and the outer switching electrode (20) is produced. Based on the operation, a switching function is produced. When the outer second brush (5*a*) is in conductive contact on the surface of the outer switching electrode (20), a turn on operating condition will be established. On the contrary, when the outer second brush (5*a*) is not in conductive contact on the surface of the outer switching electrode (20), a turn-off operating condition will be established. Besides, the inner second brush (5*b*) slides on along the inner switching electrode (21). However, when the outer second brush (5*a*) is not in contact with the outer switching electrode (20), an electric conduction between the inner switching electrode (21) and the outer switching electrode (20) is not established.

In accordance with a throttle valve opening value, as shown in FIG. 9, the brush (5*a*) slides on the surface of the outer switching electrode (20), the gap (3*b*) and the protective layer (7) in order. The protective layer (7) has a lubricating function, an abrasion of the brush (5*a*) will be decreased. Since a material (carbon paste) of the protective layer (7) accumulates on the surface of the gap (3*b*), an abrasion rate of the gap (3*b*) will be at low rate. When the carbon paste accumulated on the surface of gap (3*a*), a no short circuit condition is established which is known from an experimental conclusion.

A result of an endurance test of this embodiment is shown in a following TABLE 1. The length of the gap (3*b*) in an arbitrary manner choose another point in a range from 0.5 to 5 millimeters. An experimental data which has no protective layer (7) is shown at the right-hand column in the TABLE 1.

TABLE 1

| L (mm) | 0.3 | 0.4 | 0.5 | 0.7 | 1.5 | 4.3 | 5.0 | no layer |
|---|---|---|---|---|---|---|---|---|
| friction loss (μm) | 2 | 3 | 4 | 6 | 11 | 15 | 23 | 27 |
| insulation resistance | $2 \times 10^6$ or more | $10^8$ | | | | | | |

An insulation resistance value represents $10^8$ or more which has no protective layer (7). A decreasing tendency is seen under 0.3 mm of the length L. A range of the length L from 0.4 to 5 is an effective range in which produces an abrasion of the brush (5*a*) and the gap(3*b*).

Based on this invention, the following merits or utility is produced.

1) A protective layer (7) produces a high round durability.
2) A variable resistor with a switching mechanism which has a high durability is produced by a simple manufacturing process.
3) The simple manufacturing process can be obtained a low priced variable resistor.
4) It is possible to produce a variable resistor which has low electrical noise.

Obviously, numerous modifications and variations of the present invention are possible in light of the above teachings. It is therefore to be understood that within the scope of the appended claims, the invention may be practiced otherwise than as specifically described herein.

What is claimed is:

1. A variable resistor with a switching mechanism comprising:

a base plate;

first and second arcuate resistance portions disposed on said base plate, each of said first and second arcuate resistance portions having a layered structure;

first and second arcuate electrode portions disposed on said base plate, each of said first and second arcuate electrode portions having a layered structure;

said first arcuate electrode portion being disposed inwardly of said first arcuate resistance portion;

said second arcuate electrode portion being disposed inwardly of said second arcuate resistance portion;

an arcuate protective layer disposed on said base plate adjacent to said first arcuate electrode portion;

a movable portion having a plurality of brushes fixed thereto, said brushes being adapted to slidably contact said first and second arcuate resistance portions, said first and second arcuate electrode portions, and said arcuate protective layer, said protective layer providing a lubricating surface for sliding contact with one of said brushes; and a gap for electrically isolating said protective layer from said first electrode portion.

2. A variable resistor with a switching mechanism according to claim 1, wherein said arcuate resistance portions and said arcuate electrode portions are arranged alternately on said base plate.

3. A variable resistor with a switching mechanism according to claim 1, wherein said first and second arcuate resistance portions each comprise an upper layer and a lower layer.

4. A variable resistor with a switching mechanism according to claim 3, wherein said lower layer and said upper layer of said first and second arcuate resistance portions each comprise a resistive element.

5. A variable resistor with a switching mechanism according to claim 4, wherein the resistance value of the upper layer for each of said first and second arcuate resistance portions is grater than that of the lower layer.

6. A variable resistor with a switching mechanism according to claim 1, wherein the length of said gap ranges from 0.4 to 5 millimeters.

7. A variable resistor with a switching mechanism according to claim 1, wherein said plurality of brushes includes a first brush and a second brush each having an outer and an inner brush portion.

8. A variable resistor with a switching mechanism comprising:

a base plate;

first and second resistance portions disposed on said base plate, said first resistive portion spaced from said second resistive portion;

first and second arcuate electrodes disposed on said base plate, said first electrode spaced from said second electrode;

a protective layer made of substantially the same material as said resistive portions, said protective layer being disposed on said base plate adjacent to said first electrode and being electrically isolated from said first and second resistive portions and said first and second electrodes;

a sliding member disposed above said base plate, said sliding member having a plurality of brush elements adapted to slidably contact said first and second resistive portions, said first and second electrodes, and said protective layer.

9. The variable resistor according to claim 8, wherein said first and second resistive portions and said first and second electrodes are arcuate.

10. The variable resistor according to claim 9, wherein said first and second resistive portions and said first and second electrodes are arranged alternately on said base plate.

11. The variable resistor according to claim 8, wherein said first and second resistive portions have a layered structure.

12. The variable resistor according to claim 11, wherein said first and second electrodes have a layered structure.

13. The variable resistor according to claim 8, wherein a gap having a preselected length separates and electrically isolates said first electrode from said protective layer.

14. The variable resistor according to claim 13, wherein said plurality of brush elements comprises four brush elements, a first brush element adapted to slidably contact said first resistive portion;

a second brush element adapted to slidably contact said first electrode, said gap and said protective layer;

a third brush element adapted to slidably contact said second resistive portion; and a fourth brush element adapted to slidably contact said second electrode.

15. A variable resistor comprising:

a base plate;

at least one resistive portion disposed on said base plate;

at least one electrode disposed on said base plate;

a protective layer disposed on said base plate adjacent to said at least one electrode and electrically isolated from said at least resistive portion and said at least one electrode, said protective layer being comprised of a carbonate and a binder; and a sliding member disposed above said base plate, said sliding member having a plurality of brush elements adapted to slidably contact said at least one resistive portion, said at least one electrode, and said protective layer.

16. The variable resistor according to claim 15, wherein a gap is defined between said at least one electrode and said protective layer, said gap having a length sufficient for electrically isolating said protective layer from said at least one electrode.

17. The variable resistor according to claim 16, wherein the length of said gap ranges from 0.4 to 5 millimeters.

* * * * *